US011312602B2

(12) United States Patent
Tani et al.

(10) Patent No.: US 11,312,602 B2
(45) Date of Patent: Apr. 26, 2022

(54) HORIZONTAL CONVEYING CARRIAGE

(71) Applicant: SHIMIZU CORPORATION, Tokyo (JP)

(72) Inventors: Taku Tani, Tokyo (JP); Yuji Kinoshita, Tokyo (JP); Syunsuke Igarashi, Tokyo (JP)

(73) Assignee: SHIMIZU CORPORATION, Tokyo (JP)

( * ) Notice: Subject to any disclaimer, the term of this patent is extended or adjusted under 35 U.S.C. 154(b) by 412 days.

(21) Appl. No.: 16/476,871

(22) PCT Filed: Mar. 9, 2018

(86) PCT No.: PCT/IB2018/051538
§ 371 (c)(1),
(2) Date: Jul. 10, 2019

(87) PCT Pub. No.: WO2018/131007
PCT Pub. Date: Jul. 19, 2018

(65) Prior Publication Data

US 2019/0352158 A1 Nov. 21, 2019

(30) Foreign Application Priority Data

Jan. 13, 2017 (JP) ..... JP2017-004403

(51) Int. Cl.
*B66F 9/10* (2006.01)
*B66F 9/12* (2006.01)
*B66F 9/24* (2006.01)

(52) U.S. Cl.
CPC ..... *B66F 9/10* (2013.01); *B66F 9/12* (2013.01); *B66F 9/24* (2013.01)

(58) Field of Classification Search
CPC ..... B66F 9/10
See application file for complete search history.

(56) References Cited

U.S. PATENT DOCUMENTS 3,272,365 A * 9/1966 Stevens ..... B66F 9/105 414/633
3,715,046 A * 2/1973 Marklund ..... B60P 1/4421 414/632

(Continued)

FOREIGN PATENT DOCUMENTS

JP 57-72599 A 5/1982
JP 6-32227 A 2/1994

(Continued)

OTHER PUBLICATIONS

Machine translation of JP 6-32599 from espacenet (Year: 1994).*

(Continued)

*Primary Examiner* — Mark C Hageman
(74) *Attorney, Agent, or Firm* — Xsensus LLP

(57) ABSTRACT

A horizontal conveying carriage includes: a carriage body including: a base part; a drive wheel; and a steering wheel; a forklift attached to the carriage body, and configured to pick up a conveyed object and unload the conveyed object; an extending and shrinking mechanism configured to extend and shrink the forklift in a front-and-rear direction; a lifting and lowering mechanism configured to lift and lower the forklift in a vertical direction; a supporting mechanism configured to support the forklift from a lower side; an own position estimation unit configured to estimate an own position of the carriage body; a positional relation recognition unit configured to recognize a positional relation between the own position and the conveyed object; and a control unit configured to control movement of the carriage body and to control an operation of the forklift based on the own position and the positional relation.

11 Claims, 7 Drawing Sheets

(56) References Cited

U.S. PATENT DOCUMENTS

| | | | | |
|---|---|---|---|---|
| 4,998,858 | A * | 3/1991 | Magens | B66F 9/10 414/282 |
| 5,211,527 | A * | 5/1993 | Ahlsen | B66F 9/063 187/233 |
| 2005/0042068 | A1 * | 2/2005 | Ehmen | B66F 9/06 414/661 |
| 2012/0191272 | A1 | 7/2012 | Andersen et al. | |

FOREIGN PATENT DOCUMENTS

| | | | |
|---|---|---|---|
| JP | 6-32599 | A | 2/1994 |
| JP | 8-110815 | A | 4/1996 |
| JP | 2014-101154 | A | 6/2014 |
| JP | 2014-162578 | A | 9/2014 |

OTHER PUBLICATIONS

International Search Report and Written Opinion dated Apr. 17, 2018 for PCT/IB2018/051538 filed on Mar. 9, 2018, 8 pages including English Translation of the International Search Report.

* cited by examiner

HORIZONTAL CONVEYING CARRIAGE

CROSS-REFERENCE TO RELATED APPLICATIONS

The present application is based on PCT filing PCT/IB2018/051538, filed Mar. 9, 2018, which claims priority to JP 2017-004403, filed Jan. 13, 2017, the entire contents of each are incorporated herein by reference.

FIELD

The present invention relates to a horizontal conveying carriage that horizontally conveys an object to be conveyed such as material and equipment in a construction site and the like.

BACKGROUND

Conventionally, automation of operations has been required in the construction industry to supplement shortage of workers. Among the operations, material conveyance requires large man-hours at present, and automating the material conveyance can bring about a large effect of labor saving. The material conveyance is classified into vertical conveyance by construction work elevators and horizontal conveyance for conveying a material to a construction site by carriages or the like. Because operators manually convey a material placed on a carriage in the horizontal conveyance, too much manpower is spent on the horizontal conveyance at present.

Conventionally, to solve this problem, for example, powered carriages that automate horizontal conveyance, such as those disclosed in Patent Literatures 1 to 4, are developed and applied to actual sites. However, the powered carriages of Patent Literatures 1 to 4 each have the following problems.

The techniques disclosed in Patent Literatures 1 and 2 adopt not a counterweight system but a scissors lift system to reduce weight of a carriage and a loaded material within a floor withstand load. However, a conveyance operation is performed while a material is placed on a fork part of a forklift and lifted up, and the center of gravity is heightened and is unstable, thereby limiting conveyance objects. In addition, the way a load is placed needs to be changed depend on carriages. Conveyance using a normal material pallet is impossible. Furthermore, a carriage track involves an electromagnetic tape stuck on the ground, and sticking work of the tape requires much manpower. The tape also peels off easily, and maintenance and management of facilities take a lot of labor hours. In addition, it is impossible to flexibly respond to a change of a conveyance route.

In the techniques disclosed in Patent Literatures 3 and 4, the way a load is placed needs to be changed depending on carriages. Conveyance using a normal material pallet is impossible. Furthermore, a carriage track uses an electromagnetic tape stuck on the ground, and sticking work of the tape requires much manpower. The tape also peels off easily, and maintenance and management of facilities take a lot of labor hours. In addition, it is impossible to flexibly respond to a change of a conveyance route.

CITATION LIST

Patent Literature

Patent Literature 1: Japanese Patent Application Laid-open No. H06-32227

Patent Literature 2: Japanese Patent Application Laid-open No. H06-32599

Patent Literature 3: Japanese Patent Application Laid-open No. 2014-101154

Patent Literature 4: Japanese Patent Application Laid-open No. 2014-162578

SUMMARY

Technical Problem

Thus, a horizontal conveying carriage that can flexibly respond to a construction site and has high stability has been required.

In view of the foregoing, an object of the present invention is to provide a horizontal conveying carriage that can flexibly respond to a construction site and has high stability.

Solution to Problem

To solve the problem and achieve the object, a horizontal conveying carriage for horizontally conveying a conveyed object according to the present invention includes: a carriage body including: a base part on which a picked-up conveyed object is placed; a drive wheel; and a steering wheel; a forklift attached to the carriage body, and configured to pick up a conveyed object from an outside to the base part and unload the conveyed object; an extending and shrinking mechanism configured to extend and shrink the forklift in a front-and-rear direction; a lifting and lowering mechanism configured to lift and lower the forklift in a vertical direction; a supporting mechanism provided to prevent the forklift from being in a cantilever state while picking up/unloading the conveyed object, the supporting mechanism being configured to support the forklift from a lower side; an own position estimation unit configured to estimate an own position of the carriage body; a positional relation recognition unit configured to recognize a positional relation between the own position and the conveyed object; and a control unit configured to control movement of the carriage body using the drive wheel and the steering wheel and to control an operation of the forklift using the extending and shrinking mechanism and the lifting and lowering mechanism based on the own position and the positional relation.

Moreover, the horizontal conveying carriage according to the present invention further includes a converting mechanism configured to limit an operation of the lifting and lowering mechanism of the forklift and convert the operation of the lifting and lowering mechanism into an operation for lifting the supporting mechanism.

Moreover, in the horizontal conveying carriage according to the present invention, the supporting mechanism is formed of a scissors link mechanism in a form of scissors that is disposed between a floor surface and the forklift.

Moreover, in the horizontal conveying carriage according to the present invention, the control unit is remotely controlled from an outside through a wireless or wired communication unit.

Moreover, in the horizontal conveying carriage according to the present invention, the horizontal conveying carriage is able to autonomously travel while estimating the own position based on drawing data representing information on a position of a construction site.

Advantageous Effects of Invention

A horizontal conveying carriage according to the present invention is a horizontal conveying carriage for horizontally conveying an object to be conveyed, and includes the following: a carriage body that includes a base part for placing a picked-up conveying object, and a drive wheel and a steering wheel; a forklift that is installed on the carriage body for picking up/unloading an object to be conveyed from the outside to the base part; an extending and shrinking mechanism that extends and shrinks the forklift in a front-and-rear direction and a lifting and lowering mechanism that lifts and lowers the forklift in a vertical direction; a supporting mechanism that is provided to prevent the forklift picking up/unloading the object to be conveyed from being in a cantilever state and supports the forklift from a lower side; an own position estimation unit that estimates an own position of the carriage body; a positional relation recognition unit that recognizes a positional relation between the own position and the object to be conveyed; and a control unit that controls movement of the carriage body using the drive wheel and the steering wheel and an operation of the forklift using the extending and shrinking mechanism and the lifting and lowering mechanism based on the own position and the positional relation. Thus, the present invention can provide the horizontal conveying carriage that can flexibly respond to a construction site and has high stability.

The other horizontal conveying carriage according to the present invention further includes a converting mechanism that limits an operation of the lifting and lowering mechanism of the forklift and converts the operation into an operation for lifting the supporting mechanism. Thus, an operation of the lifting and lowering mechanism can be converted into an operation for lifting the supporting mechanism.

In the other horizontal conveying carriage according to the present invention, the supporting mechanism is formed of a scissors link mechanism in the form of scissors that is disposed between a floor surface and the forklift. Thus, stability of the forklift can be enhanced while an increase in weight of the carriage is avoided.

In the other horizontal conveying carriage according to the present invention, the control unit is remotely controlled by the outside through a wireless or wired communication unit. Thus, the horizontal conveying carriage can be remotely controlled.

The other horizontal conveying carriage according to the present invention is capable of autonomously traveling while estimating the own position based on drawing data representing information on a position of a construction site. Thus, autonomous travel of the horizontal conveying carriage can be implemented.

DESCRIPTION OF EMBODIMENT

An embodiment of a horizontal conveying carriage according to the present invention will now be described in detail with reference to the accompanying drawings. It should be noted that this embodiment is not intended to the present invention.

Figure 1:
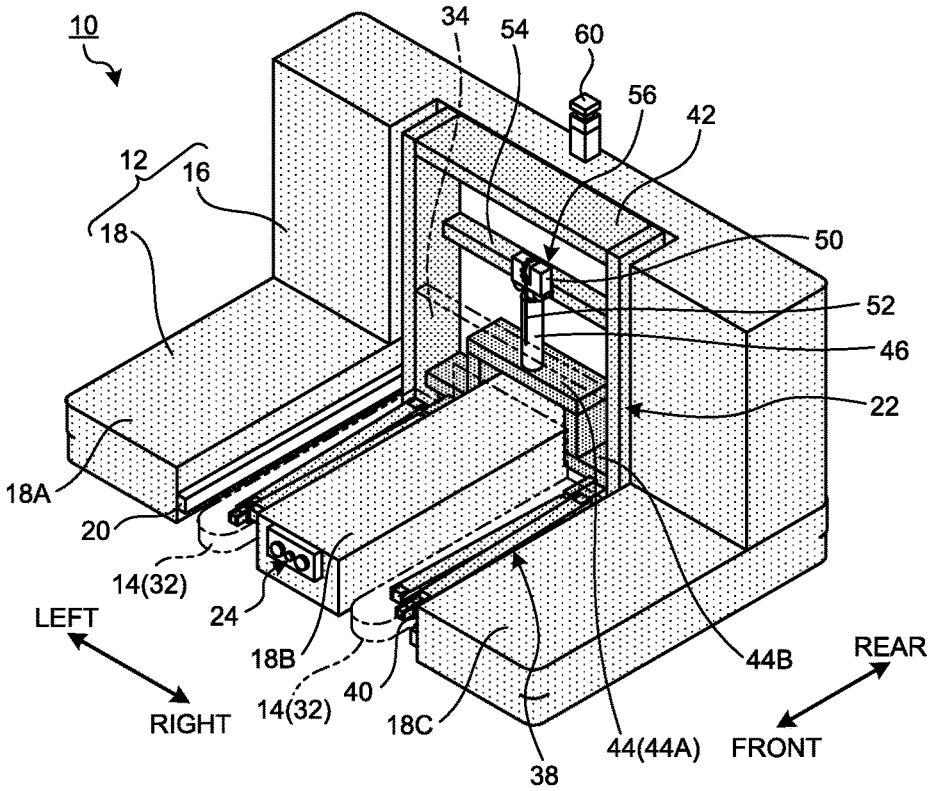
FIG. 1 is a perspective view schematically illustrating an embodiment of a horizontal conveying carriage according to the present invention (at the time of a conveyance mode).
Figure 2:
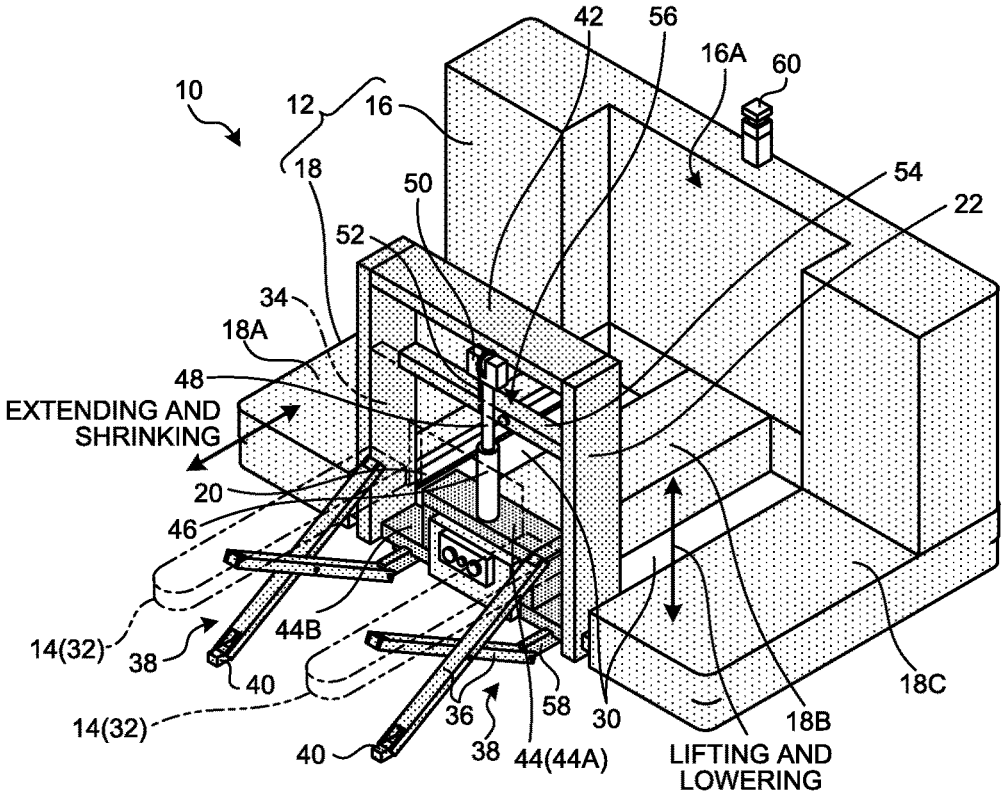
FIG. 2 is a perspective view schematically illustrating the embodiment of the horizontal conveying carriage according to the present invention (at the time of picking up a load).
Figure 3:
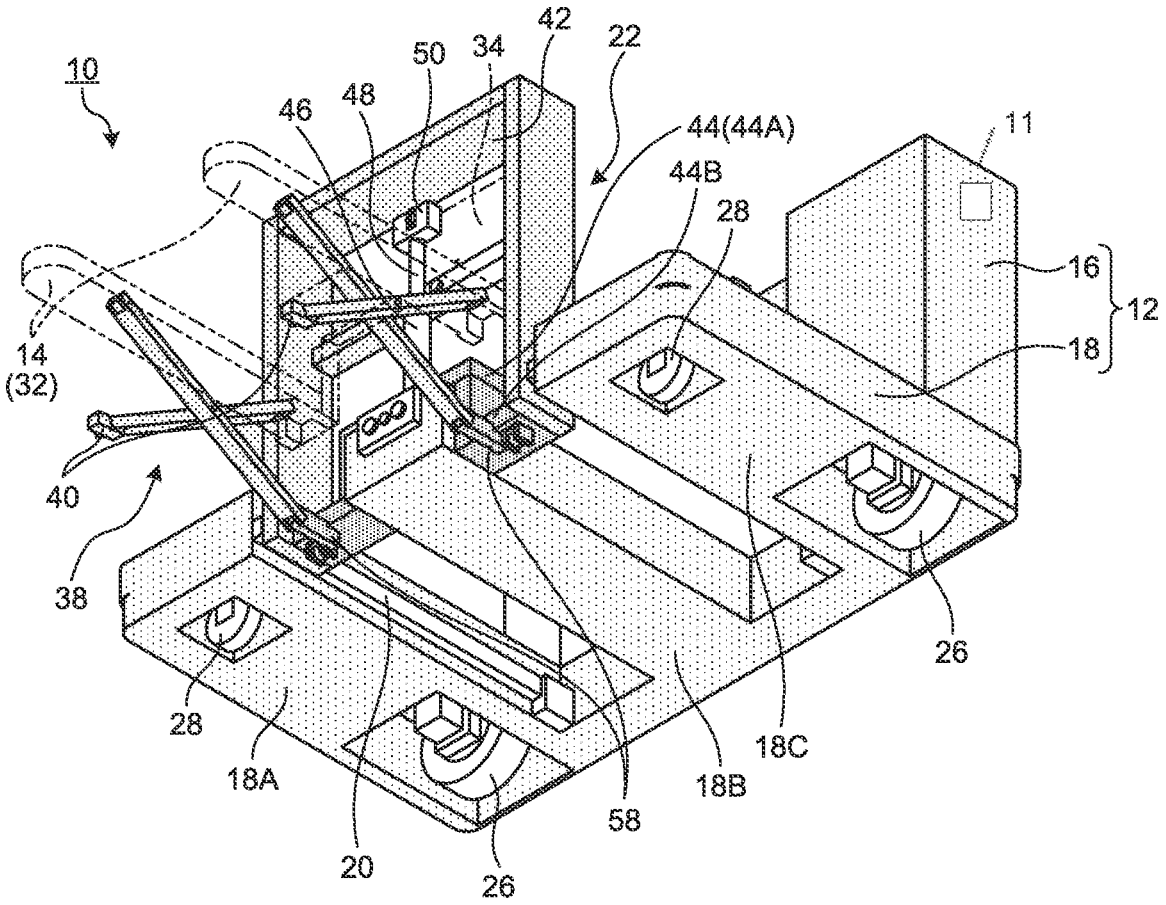
FIG. 3 is a perspective view schematically illustrating the horizontal conveying carriage in FIG. 2 that is viewed from a lower surface (at the time of picking up a load).

As illustrated in FIGS. 1 to 3, a horizontal conveying carriage 10 according to the present invention is a carriage for horizontally conveying a load (object to be conveyed) such as material and equipment, and includes a carriage body 12 and a forklift 14. In each drawing, the forklift is illustrated by not a solid line but a dashed-dotted line.

The carriage body 12 is a structure body having approximately an L-shaped cross-sectional surface in a side face view, and is formed of a vertical wall part 16 and a base part 18. This carriage body 12 includes an extending and shrinking mechanism 20 that extends and shrinks the forklift 14 in a front-and-rear direction and a lifting and lowering mechanism 22 that lifts and lowers the forklift 14 in a vertical direction. The vertical wall part 16 is a wall-like part that rises upward from the rear end of the base part 18. The base part 18 is a flat part for placing a material that is picked up by the forklift 14, and is separated into three base parts 18A, 18B, and 18C on the left side, the center side, and the right side, respectively, sandwiching the forklift 14. On each of the base parts 18A, 18B, and 18C, unillustrated three battens of a material pallet serving as an object to be conveyed can be loaded. On a front end surface of the base part 18B on the center side, a twin-lens camera sensor 24 (positional relation recognition unit) is installed. This twin-lens camera sensor 24 is a camera sensor that calculates a relative distance and an angle with respect to an unillustrated marker attached to an object to be conveyed such as a material pallet and a material. By reading the marker with this twin-lens camera sensor 24, a positional relation (relative position) between an object to be conveyed and the carriage body 12 can be detected, and using this detection result enables the carriage body 12 to face the object to be conveyed.

As illustrated in FIG. 3, on four corner sides of a lower surface of the carriage body 12, electric-powered drive steering wheels 26 and steering wheels 28 are provided. The drive steering wheels 26 are positioned on the right and left of a rear side of the lower surface of the carriage body 12, and freely move the horizontal conveying carriage 10 while supporting weight of the horizontal conveying carriage 10 and a load loaded on the horizontal conveying carriage 10. The steering wheels 28 are positioned on the right and left of a front side of the lower surface of the carriage body 12, and freely move the horizontal conveying carriage 10. The steering wheels 28 also support weight of the horizontal conveying carriage 10 and a load loaded on the horizontal conveying carriage 10 together with the drive steering wheels 26. To implement free movement of the horizontal conveying carriage 10, the steering wheels 28 and the drive steering wheels 26 are steered independently of each other.

The forklift 14 picks up/unloads a load from an unillustrated yard to the horizontal conveying carriage 10, and is installed on the carriage body 12 through the extending and shrinking mechanism 20 and the lifting and lowering mechanism 22. This forklift 14 includes two long box-like forks 32 that are disposed parallel to grooves 30 on both sides of the base part 18B on the center side and extend in a front-and-rear direction, and a link frame 34 that links both rear ends of the forks 32 in an inverted U-shape and is installed on the extending and shrinking mechanism 20 and the lifting and lowering mechanism 22.

On the lower side of each of the forks 32, a scissors link mechanism 38 (supporting mechanism) where two link members 36 are assembled in the form of scissors (X-shape) is provided. This scissors link mechanism 38 prevents the forks 32 of the forklift 14 from being in a cantilever state. Normally, when the forks 32 are in a cantilever state, a counterweight that prevents a fall at the time of lifting a load is required. Thus, weight of a carriage is increased and may exceed a floor withstand load of a building in which the horizontal conveying carriage 10 is disposed. By contrast, according to the present embodiment, the scissors link mechanism 38 can perform a forking operation without a counterweight. Thus, weight of a carriage can be reduced and the horizontal conveying carriage 10 can be applied without floor reinforcing of a building. A wheel 40 is installed on a lower part of the front end of the one link member 36 in this scissors link mechanism 38 so as to implement smooth movement at the time of expanding the scissors link mechanism 38. In addition, an upper part of the rear end of the one link member 36 is rotatably fixed to a lower part of the rear end of the fork 32. As described later, a lower part of the rear end of the other link member 36 is rotatably fixed to a lower frame 44, and an upper part of the front end thereof is rotatably fixed to a lower part of the front end of the fork 32.

The lifting and lowering mechanism 22 of the forklift 14 is formed of a gate-type upper frame 42 that is disposed upward across the base part 18B on the center side, the lower frame 44 that is disposed to be vertically liftable and lowerable in the upper frame 42, a cylinder 46 that vertically links the lower frame 44 with the link frame 34 of the forklift 14, and an unillustrated lifting and lowering driving source that drives the cylinder 46. The lower end of the cylinder 46 is fixed to an upper end surface of the lower frame 44, and the upper end of a piston rod 48 projecting upward from the cylinder 46 is fixed to the link frame 34 through a pin engagement unit 50 and a connecting member 52. In this lifting and lowering mechanism 22, when the piston rod 48 extends upward from the cylinder 46, the forks 32 are lifted through the pin engagement unit 50, the connecting member 52, and the link frame 34. By contrast, when the piston rod 48 shrinks, the forks 32 are lowered through the link frame 34.

An intermediate member 54 that extends in a horizontal direction is provided to approximately an intermediate position of the upper frame 42 in a vertical direction. On a front side of the center part of the intermediate member 54 in the horizontal direction, two scissors jump-up pins 56 (converting mechanism) are provided at a position sandwiching the piston rod 48 of the cylinder 46 so as to freely move forward and backward. The scissors jump-up pins 56 limit movement of the piston rod 48 through the pin engagement unit 50 so as to convert the movement into an operation for jumping up the scissors link mechanism 38. Fixing the upper end of the piston rod 48 to the intermediate member 54 through the scissors jump-up pins 56 allows the lower frame 44 to vertically move through the lower end of the cylinder 46.

The lower frame 44 is formed of a center part 44A in an inverted U-shape along with an upper surface and side surfaces of the base part 18B on the center side, and side parts 44B that extend in the grooves 30 from the lower end of the center part 44A to the outside in the horizontal direction. Connecting members 58 are installed on the front side of the side parts 44B, and each of the connecting members 58 has a lower part of the rear end of the one link member 36 in the scissors link mechanism 38 rotatably connected thereto.

In this converting mechanism, when the scissors jump-up pins 56 project from the intermediate member 54 so as to make the pin engagement unit 50 on the upper end of the piston rod 48 and the intermediate member 54 in a fixed state, the lower frame 44 is in a vertically movable state through the lower end of the cylinder 46. When the piston rod 48 of the cylinder 46 is shrunk in this state, the lower frame 44 lifts, and the scissors link mechanism 38 leaves a floor surface through the side parts 44B and the connecting members 58. This operation places the horizontal conveying carriage 10 into a movable mode. By contrast, when the piston rod 48 is extended, the lower frame 44 lowers, lower parts of the rear ends of the link members 36 in the scissors link mechanism 38 abut on a floor surface through the side parts 44B and the connecting members 58 so as to be rotation fulcrums, and the scissors link mechanism 38 expands and forms a posture of jumping up the forks 32 from a lower side.

When the scissors jump-up pins 56 are stored in the intermediate member 54 and engagement of the pin engagement unit 50 on the upper end of the piston rod 48 and the intermediate member 54 is released, the forks 32 are in a vertically liftable and lowerable state through the piston rod 48, the pin engagement unit 50, the connecting member 52, and the link frame 34. When the piston rod 48 of the cylinder 46 is shrunk in this state, the forks 32 are lowered. When the piston rod 48 is extended, the forks 32 are lifted. At this time, while supporting the forks 32, the scissors link mechanism 38 is deformed to expand/is deformed to shrink corresponding to lifting/lowering of the forks 32.

The extending and shrinking mechanism 20 is formed of rails that extend in a front-and-rear direction on internal surfaces of the base part 18A on the left side and the base part 18C on the right side, unillustrated sliders along with the rails that allow the lower end of the upper frame 42 to slide in a front-and-rear direction along with the base part 18, and an unillustrated extending and shrinking driving source that drives the sliders. In this extending and shrinking mechanism 20, when the upper frame 42 slidably moves to the rear end of the rails, the lower frame 44 and the link frame 34 also move integrally with the upper frame 42. In this manner, the forks 32 shrink, enter the grooves 30 in the base part 18, and are housed between the base parts 18A or 18C and 18B, and the upper frame 42 is also housed in a recessed part 16A in the vertical wall part 16 of the carriage body 12. By contrast, when the upper frame 42 slidably moves to the front end of the rails, the lower frame 44 and the link frame 34 also move integrally with the upper frame 42, and the forks 32 extend and are in a state of projecting forward from the grooves 30 in the base part 18.

The horizontal conveying carriage 10 described above includes a laser sensor 60 that estimates an own position of the carriage body 12 (own position estimation unit), the twin-lens camera sensor 24 described above that recognizes a positional relation between the own position and an object to be conveyed (positional relation recognition unit), and an control unit or controller 11 that controls movement of the carriage body 12 using the drive steering wheels 26 and the steering wheels 28 and an operation of the forklift 14 using the extending and shrinking mechanism 20 and the lifting and lowering mechanism 22 based on the estimated own position and the recognized positional relation. This control unit can be remotely controlled by the outside through a wireless or wired communication unit.

The laser sensor 60 is provided to a central upper end of the vertical wall part 16 in the carriage body 12. This laser sensor 60 is a sensor capable of acquiring a state such as a shape of the surroundings as two-dimensional information by irradiating the surroundings with laser light. A current position of the horizontal conveying carriage 10 can be determined by overlapping the two-dimensional information acquired by the laser sensor 60 with the known drawing information on a construction site where the horizontal conveying carriage 10 is used and using the overlapped information.

Load Picking-Up/Unloading Operation

The following describes a flow of a load picking-up/unloading operation performed by the horizontal conveying carriage 10 described above. The load picking-up/unloading operation can be implemented by the procedures of FIGS. 4 to 12.

Figure 4:
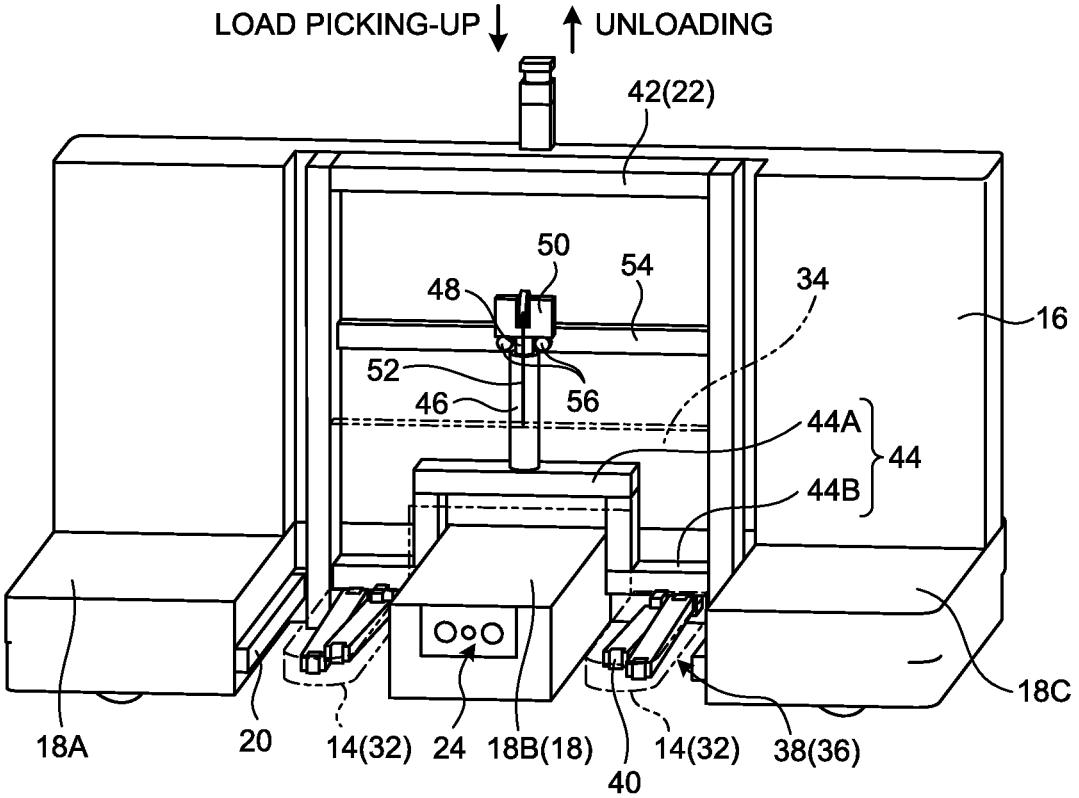
FIG. 4 is a view illustrating a conveyance state of the horizontal conveying carriage according to the present invention (scissors link mechanism storage state).

FIG. 4 illustrates a conveyance state. As illustrated in FIG. 4, this state shows that the lower frame 44 is pulled up by the cylinder 46 so as to store the scissors link mechanism 38.

Figure 5:
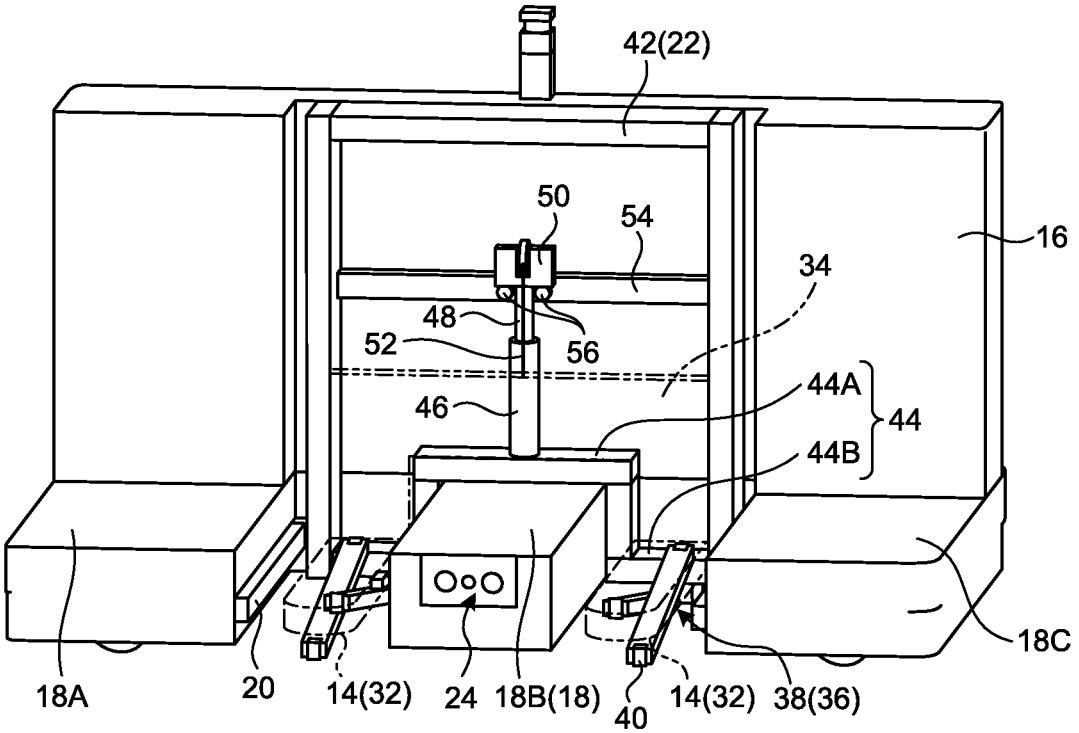
FIG. 5 is a view illustrating a first load picking-up preparation state of the horizontal conveying carriage according to the present invention (during expansion of a scissors link mechanism/lower frame lowering state).

FIG. 5 illustrates a first load picking-up preparation state. As illustrated in FIG. 5, this state shows that the cylinder 46 is extended and the lower frame 44 lowers so as to expand the scissors link mechanism 38.

Figure 6:
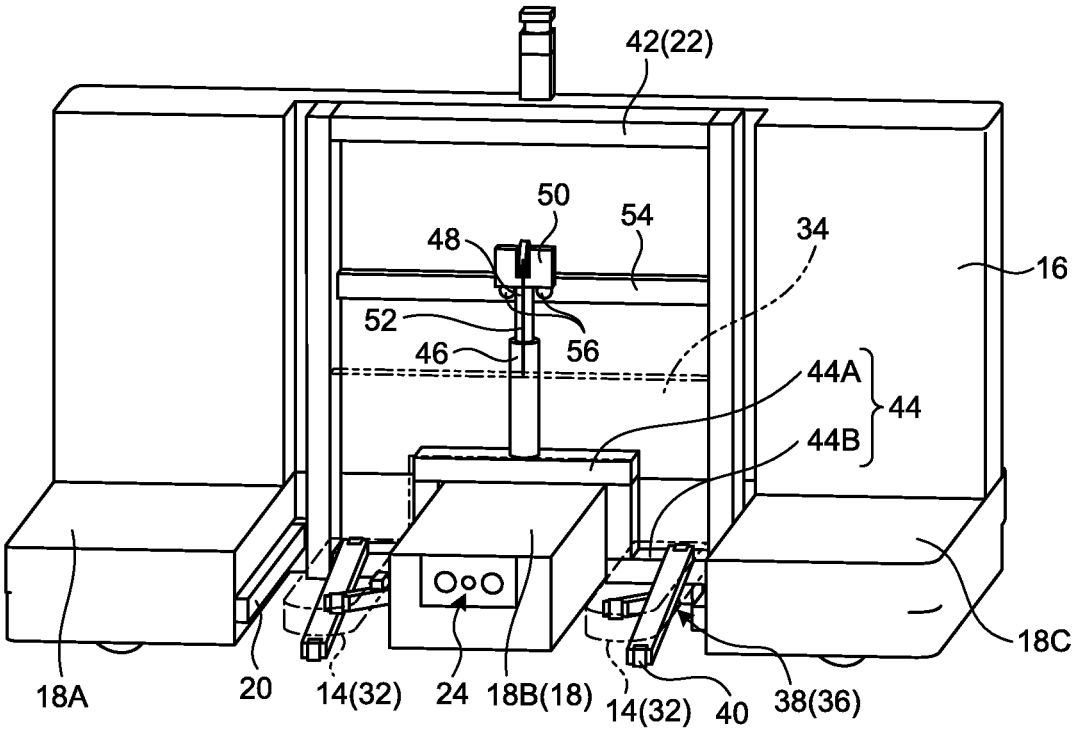
FIG. 6 is a view illustrating a second load picking-up preparation state of the horizontal conveying carriage according to the present invention (during expansion of the scissors link mechanism/scissors jump-up pin storage state)

FIG. 6 illustrates a second load picking-up preparation state. As illustrated in FIG. 6, this state shows that the scissors jump-up pins 56 are stored and movement of the cylinder 46 allows the forklift 14 to lift and lower.

Figure 7:
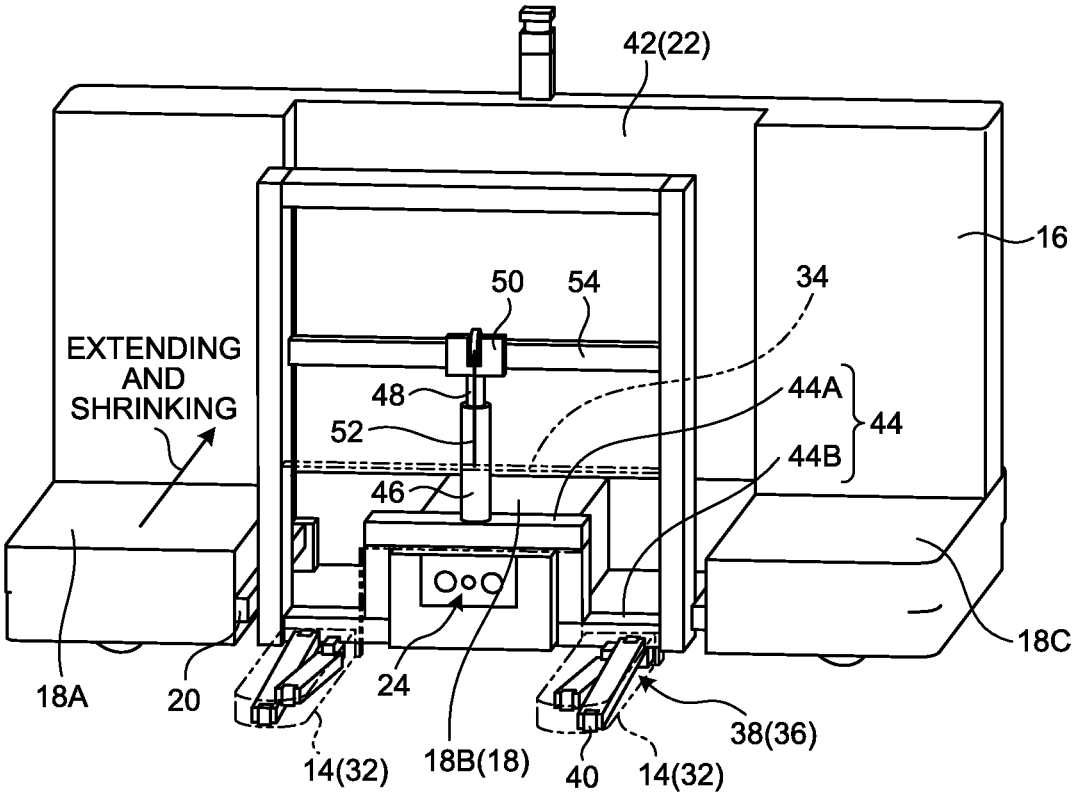
FIG. 7 is a view illustrating a first load picking-up state of the horizontal conveying carriage according to the present invention (fork extension state/state in which forks are inserted into a material pallet).

FIG. 7 illustrates a first load picking-up state. As illustrated in FIG. 7, this state shows that the forklift 14 is extended from the carriage body 12 and the forks 32 are inserted into an unillustrated material pallet.

Figure 8:
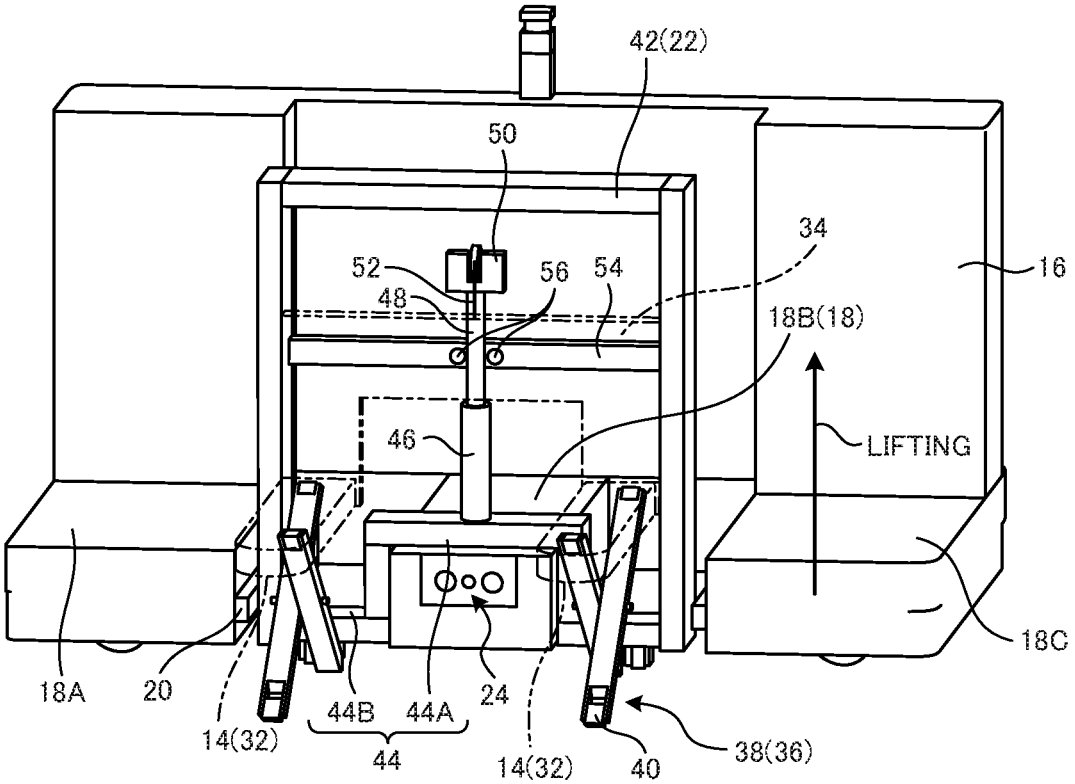
FIG. 8 is a view illustrating a second load picking-up state of the horizontal conveying carriage according to the present invention (fork extension and lifting state/state in which the forks are inserted into the material pallet and are lifted).

FIG. 8 illustrates a second load picking-up state. As illustrated in FIG. 8, this state shows that the forks 32 are inserted into the unillustrated material pallet and are lifted.

Figure 9:
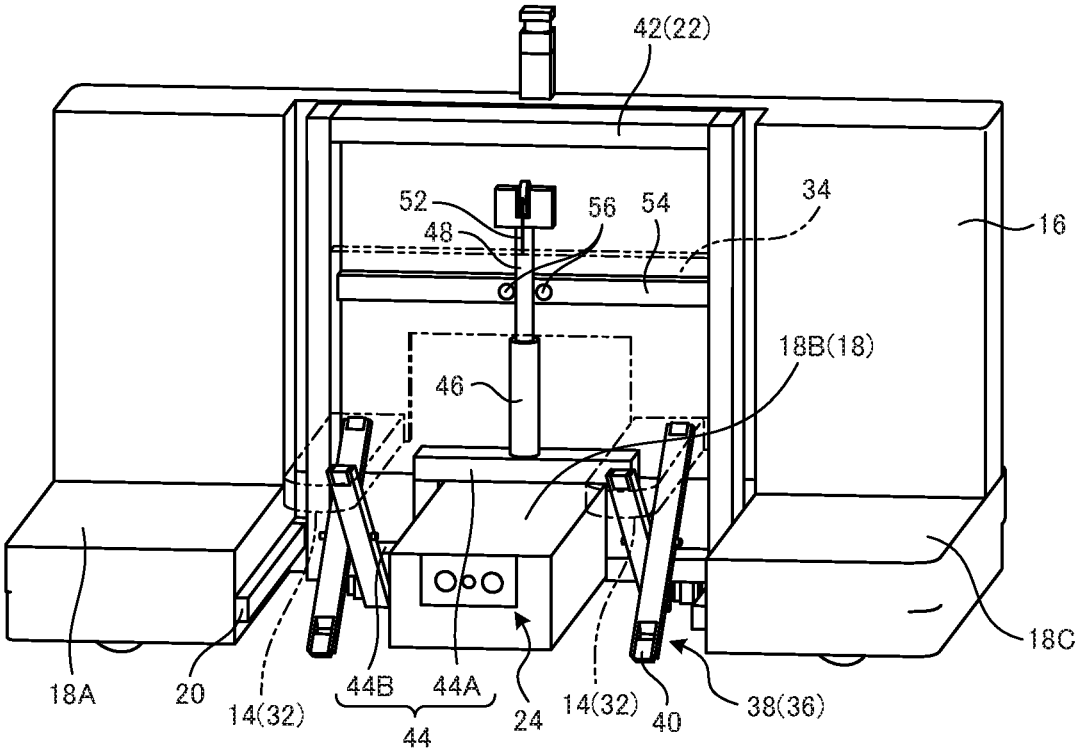
FIG. 9 is a view illustrating a third load picking-up state of the horizontal conveying carriage according to the present invention (fork storage and lifting state/state in which a load is drawn into a base part).

FIG. 9 illustrates a third load picking-up state. As illustrated in FIG. 9, this state shows that the forks 32 on which the unillustrated material pallet is placed are drawn into a carriage body 12 side.

Figure 10:
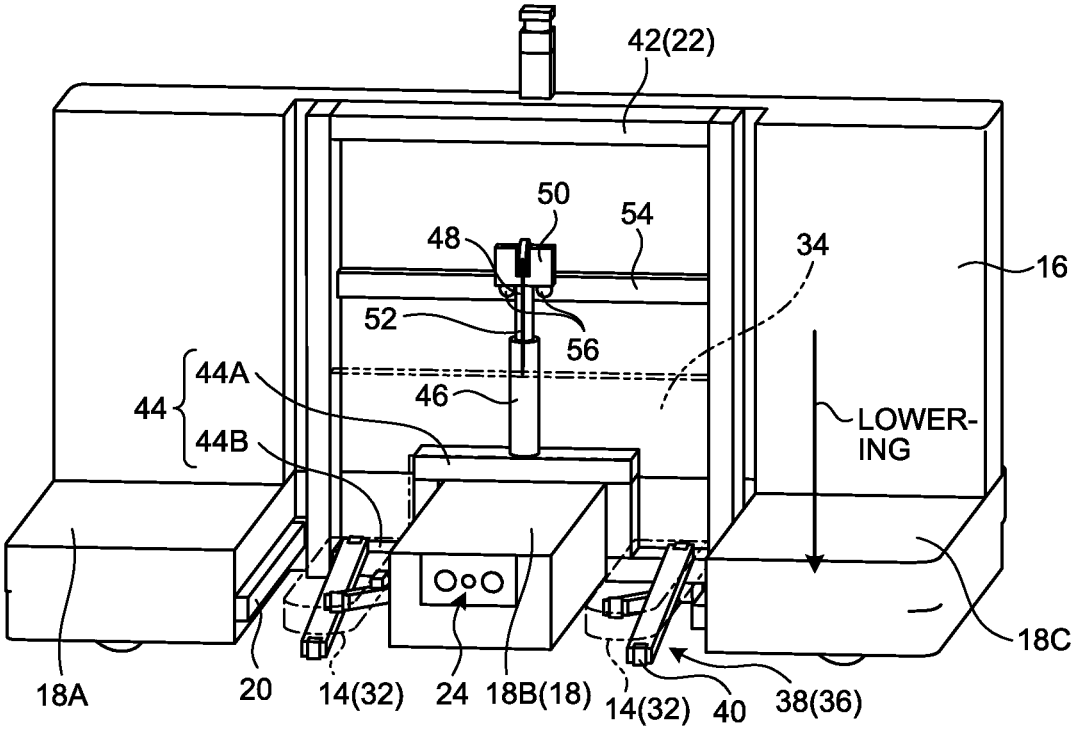
FIG. 10 is a view illustrating a fourth load picking-up state of the horizontal conveying carriage according to the present invention (fork storage and lowering state/state in which the load is reloaded into the base part).

FIG. 10 illustrates a fourth load picking-up state. As illustrated in FIG. 10, this state shows that the forks 32 are lowered and an unillustrated load is reloaded into the base part 18.

Figure 11:
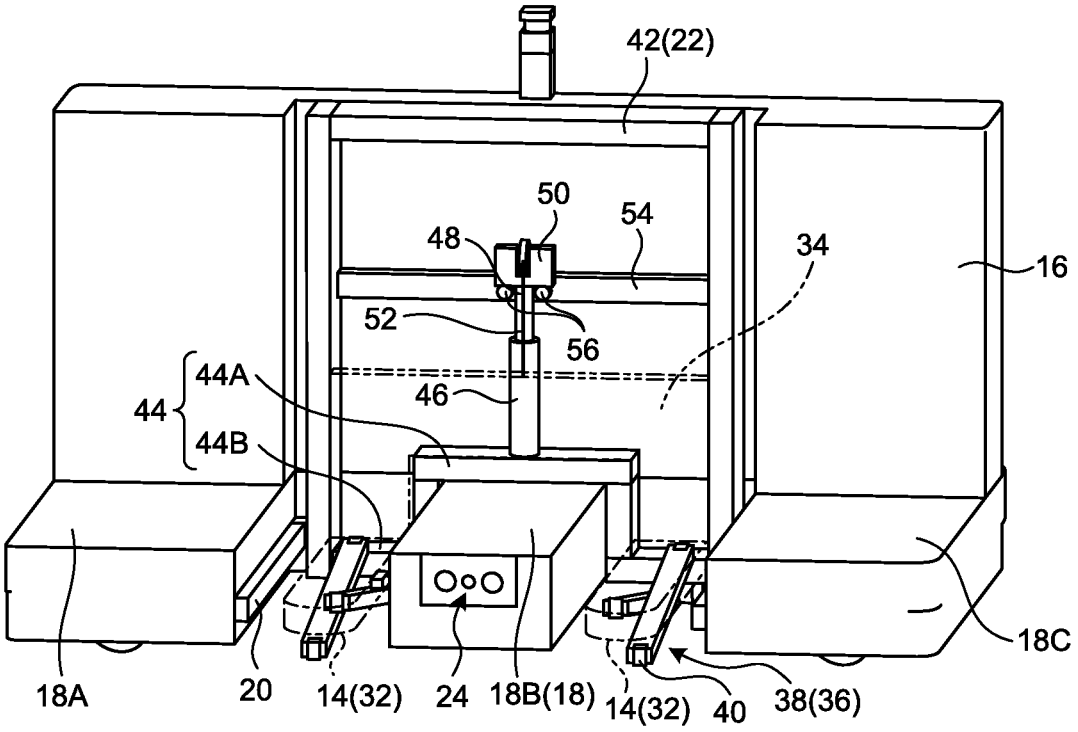
FIG. 11 is a view illustrating a first load picking-up finish state of the horizontal conveying carriage according to the present invention (during expansion of the scissors link mechanism/scissors jump-up pin expansion state).

FIG. 11 illustrates a first load picking-up finish state. As illustrated in FIG. 11, this state shows that the scissors jump-up pins 56 are expanded so as to restrict movement of the upper end of the piston rod 48 of the cylinder 46.

Figure 12:
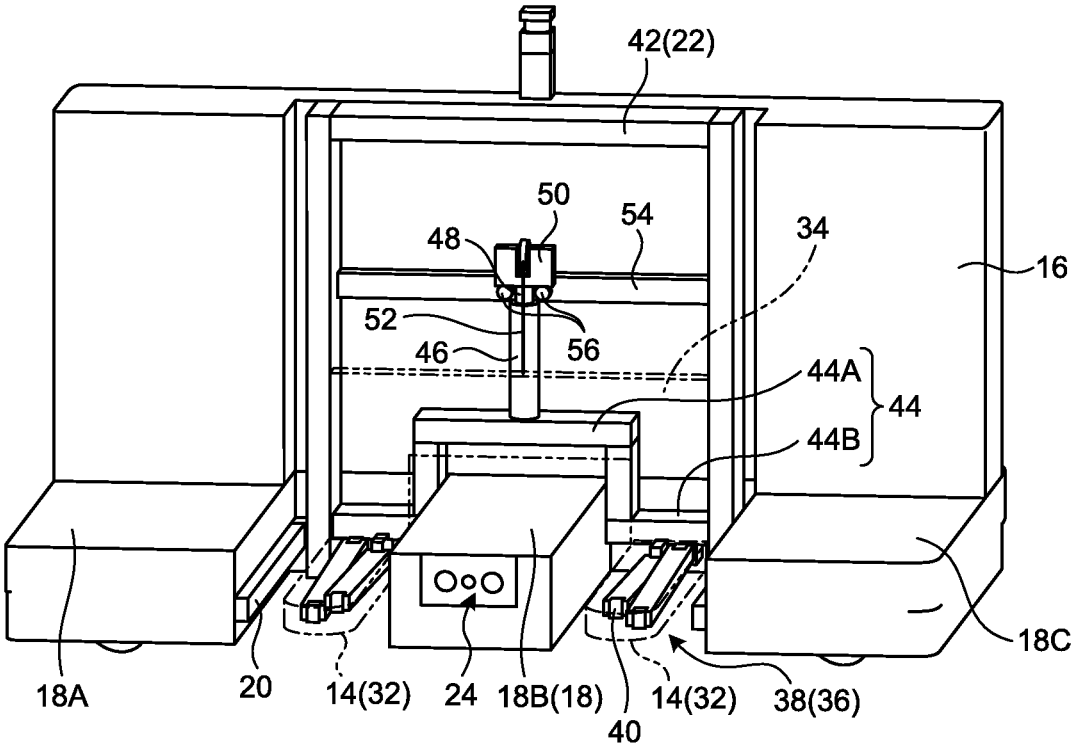
FIG. 12 is a view illustrating a second load picking-up finish state of the horizontal conveying carriage according to the present invention (scissors link mechanism storage completion).

FIG. 12 illustrates a second load picking-up finish state. As illustrated in FIG. 12, this state shows that the cylinder 46 in which the upper end of the piston rod 48 is restricted causes the lower frame 44 to lift so as to store the scissors link mechanism 38 installed on the lower frame 44.

In this manner, by loading/conveying an object to be conveyed, the horizontal conveying carriage 10 according to the present embodiment can keep the center of carriage gravity at the time of conveyance low and stably convey the material without spoiling adaptability to a material of a forklift carriage.

Conveyance Operation

The following describes a conveyance operation of the horizontal conveying carriage 10 described above. As described above, because the horizontal conveying carriage 10 includes the laser sensor 60 that estimates an own position of the carriage body 12, the twin-lens camera sensor 24 that recognizes a positional relation between the own position and an object to be conveyed, and a control unit that controls movement of the carriage body 12 using the drive steering wheels 26 and the steering wheels 28 and an operation of the forklift 14 using the extending and shrinking mechanism 20 and the lifting and lowering mechanism 22 based on the estimated own position and the recognized positional relation, the horizontal conveying carriage 10 is capable of autonomously traveling while estimating the own position by overlapping two-dimensional region measurement information acquired by the laser sensor 60 with known drawing data of a construction site. For this reason, the horizontal conveying carriage 10 does not require a unit for guiding a course such as an electromagnetic tape. This configuration can implement a trackless carriage. In addition, with the control unit, the horizontal conveying carriage 10 can move while estimating the own position, face a load serving as an object to be conveyed, and allow the forklift 14 to pick up/unload the load.

For example, when a load is picked up, the control unit may perceive a distance and an angle with a material pallet through the twin-lens camera sensor 24, and cause the carriage body 12 to face the material pallet, and after that, allow the forklift 14 to operate through the lifting and lowering mechanism 22 and the extending and shrinking mechanism 20 to pick up the material pallet. The horizontal conveying carriage 10 may move in a construction side while estimating the own position through the laser sensor 60 and unload the material pallet at a predetermined position.

In this manner, the present embodiment enables automation/labor saving of conveyance operations in a construction site. In addition, the present embodiment can build an automatic conveyance system that is applicable without floor reinforcing of a building. Furthermore, the present embodiment can achieve improvement in stability and safety of a conveyance system using a low center-of-gravity forklift carriage. The present embodiment can also respond to various kinds of loads by adoption of a forklift carriage. Furthermore, the present embodiment can build an automatic conveyance system capable of flexibly responding to a change of a plan because there is no need to stick an electromagnetic tape for guiding a carriage and the like on a floor.

As described above, the horizontal conveying carriage according to the present invention is a horizontal conveying carriage for horizontally conveying an object to be conveyed, and includes the following: a carriage body that includes a base part for placing a picked-up conveying object, and drive wheels and steering wheels; a forklift that is installed on the carriage body for picking up/unloading an object to be conveyed from the outside to the base part; an extending and shrinking mechanism that extends and shrinks the forklift in a front-and-rear direction and a lifting and lowering mechanism that lifts and lowers the forklift in a vertical direction; a supporting mechanism that is provided to prevent the forklift picking up/unloading an object to be conveyed from being in a cantilever state and supports the forklift from a lower side; an own position estimation unit that estimates an own position of the carriage body; a positional relation recognition unit that recognizes a positional relation between the own position and an object to be conveyed; and a control unit that controls movement of the carriage body using the drive wheels and the steering wheels and an operation of the forklift using the extending and shrinking mechanism and the lifting and lowering mechanism based on the own position and the positional relation. Thus, the present invention can provide the horizontal conveying carriage that can flexibly respond to a construction site and has high stability.

The other horizontal conveying carriage according to the present invention further includes a converting mechanism that limits an operation of the lifting and lowering mechanism of the forklift and converts the operation into an operation for lifting the supporting mechanism. Thus, the horizontal conveying carriage can convert an operation of the lifting and lowering mechanism into an operation for lifting the supporting mechanism.

In the other horizontal conveying carriage of the present invention, the supporting mechanism is formed of a scissors link mechanism in the form of scissors that is disposed between a floor surface and the forklift. Thus, the horizontal conveying carriage can enhance stability of the forklift while avoiding an increase in weight of the carriage.

In the other horizontal conveying carriage of the present invention, the control unit is remotely controlled by the outside through a wireless or wired communication unit. Thus, the horizontal conveying carriage can be remotely controlled.

The other horizontal conveying carriage according to the present invention is capable of autonomously traveling while estimating the own position based on drawing data representing information on a position of a construction site. Thus, autonomous travel of the horizontal conveying carriage can be implemented.

INDUSTRIAL APPLICABILITY

As above, the horizontal conveying carriage according to the present invention is useful to horizontally convey an object to be conveyed such as material and equipment and the like in a construction site and the like, and is suitable for providing, especially, the horizontal conveying carriage that can flexibly respond to various kinds of construction sites and has high stability.

REFERENCE SIGNS LIST

10 HORIZONTAL CONVEYING CARRIAGE
12 CARRIAGE BODY
14 FORKLIFT
16 VERTICAL WALL PART
16A RECESSED PART
18, 18A, 18B, 18C BASE PART
20 EXTENDING AND SHRINKING MECHANISM
22 LIFTING AND LOWERING MECHANISM
24 TWIN-LENS CAMERA SENSOR (POSITIONAL RELATION RECOGNITION UNIT)
26 DRIVE STEERING WHEEL
28 STEERING WHEEL
30 GROOVE
32 FORK
34 LINK FRAME
36 LINK MEMBER
38 SCISSORS LINK MECHANISM (SUPPORTING MECHANISM)
40 WHEEL
42 UPPER FRAME
44 LOWER FRAME
44A CENTER PART
44B SIDE PART
46 CYLINDER
48 PISTON ROD
50 PIN ENGAGEMENT UNIT
52, 58 CONNECTING MEMBER
54 INTERMEDIATE MEMBER
56 SCISSORS JUMP-UP PIN (CONVERTING MECHANISM)
60 LASER SENSOR (OWN POSITION ESTIMATION UNIT)

The invention claimed is:

1. A horizontal conveying carriage for horizontally conveying a conveyed object, the horizontal conveying carriage comprising:

a carriage body including: a base part on which a picked-up conveyed object is placed; a drive wheel; and a steering wheel;

a forklift attached to the carriage body, and configured to pick up a conveyed object from an outside to the base part and unload the conveyed object from the base part to the outside;

an extending and shrinking mechanism configured to extend and shrink the forklift in a front-and-rear direction;

a lifting and lowering mechanism configured to lift and lower the forklift in a vertical direction;

a supporting mechanism provided to prevent the forklift from being in a cantilever state while picking up/unloading the conveyed object, the supporting mechanism being configured to support the forklift from a lower side;

an own position estimation unit configured to estimate an own position of the carriage body;

a positional relation recognition unit configured to recognize a positional relation between the own position and the conveyed object;

a controller configured to control movement of the carriage body using the drive wheel and the steering wheel and to control an operation of the forklift using the extending and shrinking mechanism and the lifting and lowering mechanism based on the own position and the positional relation; and a converting mechanism configured to limit an operation of the lifting and lowering mechanism of the forklift and convert the operation of the lifting and lowering mechanism into an operation for lifting the supporting mechanism.

2. The horizontal conveying carriage according to claim 1, wherein the supporting mechanism is formed of a scissors link mechanism in a form of scissors that is disposed between a floor surface and the forklift.

3. The horizontal conveying carriage according to claim 2, wherein the controller is remotely controlled from an outside through a wireless or wired communication unit.

4. The horizontal conveying carriage according to claim 3, wherein the horizontal conveying carriage is able to autonomously travel while estimating the own position based on drawing data representing information on a position of a construction site.

5. The horizontal conveying carriage according to claim 2, wherein the horizontal conveying carriage is able to autonomously travel while estimating the own position based on drawing data representing information on a position of a construction site.

6. The horizontal conveying carriage according to claim 1, wherein the controller is remotely controlled from an outside through a wireless or wired communication unit.

7. The horizontal conveying carriage according to claim 6, wherein the horizontal conveying carriage is able to autonomously travel while estimating the own position based on drawing data representing information on a position of a construction site.

8. The horizontal conveying carriage according to claim 1, wherein the horizontal conveying carriage is able to autonomously travel while estimating the own position based on drawing data representing information on a position of a construction site.

9. A horizontal conveying carriage for horizontally conveying a conveyed object, the horizontal conveying carriage comprising:

a carriage body including: a base part on which a picked-up conveyed object is placed; a drive wheel; and a steering wheel;

a forklift attached to the carriage body, and configured to pick up a conveyed object from an outside to the base part and unload the conveyed object from the base part to the outside;

an extending and shrinking mechanism configured to extend and shrink the forklift in a front-and-rear direction;

a lifting and lowering mechanism configured to lift and lower the forklift in a vertical direction;

a supporting mechanism provided to prevent the forklift from being in a cantilever state while picking up/unloading the conveyed object, the supporting mechanism being configured to support the forklift from a lower side;

an own position estimation unit configured to estimate an own position of the carriage body;

a positional relation recognition unit configured to recognize a positional relation between the own position and the conveyed object; and a converting mechanism configured to limit an operation of the lifting and lowering mechanism of the forklift and convert the operation of the lifting and lowering mechanism into an operation for lifting the supporting mechanism.

10. The horizontal conveying carriage according to claim 9, wherein the supporting mechanism is formed of a scissors link mechanism in a form of scissors that is disposed between a floor surface and the forklift.

11. The horizontal conveying carriage according to claim 9, wherein the horizontal conveying carriage is able to autonomously travel while estimating the own position based on drawing data representing information on a position of a construction site.

* * * * *